US005609726A

United States Patent [19]

Sollinger

[11] Patent Number: 5,609,726

[45] Date of Patent: Mar. 11, 1997

[54] HEADBOX AND METHOD FOR PRODUCING MULTILAYER AND MULTI-PLY PAPER WEBS

[75] Inventor: Hans-Peter Sollinger, Heidenheim, Germany

[73] Assignee: J.M. Voith GmbH, Heidenheim, Germany

[21] Appl. No.: 266,425

[22] Filed: Jun. 27, 1994

[30] Foreign Application Priority Data

Jun. 28, 1993 [DE] Germany ..... 43 21 268.9

[51] Int. Cl.[6] ..... D21F 11/04

[52] U.S. Cl. ..... 162/125; 162/123; 162/131; 162/336; 162/343; 162/DIG. 11

[58] Field of Search ..... 162/258, 259, 162/DIG. 11, 198, 336, 343, 123, 125, 130, 131

[56] References Cited

U.S. PATENT DOCUMENTS

| | | | |
|---|---|---|---|
| 3,384,537 | 5/1968 | Keller | 162/125 |
| 3,711,688 | 1/1973 | Stout et al. | 235/151.1 |
| 3,839,143 | 10/1974 | Suckow | 162/123 |
| 4,141,788 | 2/1979 | Justus | 162/125 |
| 4,765,868 | 8/1988 | Fujiwara | 162/343 |
| 4,898,643 | 2/1990 | Weisshuhn et al. | 162/259 |
| 5,104,488 | 4/1992 | Chase | 162/198 |

FOREIGN PATENT DOCUMENTS

| | | | |
|---|---|---|---|
| 0434305 | 6/1991 | European Pat. Off. | D21F 1/02 |
| 2543495 | 4/1976 | Germany . | |
| 4029545 | 3/1992 | Germany | D21F 1/02 |
| 4031038 | 4/1992 | Germany | D21F 11/04 |
| 9205111 | 7/1992 | Germany . | |
| 4323263 | 1/1994 | Germany . | |

*Primary Examiner*—Donald E. Czaja
*Assistant Examiner*—Calvin Padgett
*Attorney, Agent, or Firm*—Baker & Daniels

[57] ABSTRACT

A multilayer headbox of a paper machine for producing a paper web with several layers having different properties, and an appropriate method therefor. In at least one first layer there is adjusted alone the fiber orientation cross profile and in at least one second layer there is adjusted alone the basis weight cross profile.

12 Claims, 1 Drawing Sheet

HEADBOX AND METHOD FOR PRODUCING MULTILAYER AND MULTI-PLY PAPER WEBS

BACKGROUND OF THE INVENTION

The invention concerns a headbox for producing a multilayer or multi-ply paper web, and a method for producing such a paper web.

A multilayer headbox is known, e.g., from DE-OS 40 29 545 A1. It serves the production of a multilayer paper web, wherein the individual nozzle spaces are supplied with stock suspension independently of one another. Pivotable blades extend across the entire machine width and are arranged between the individual nozzle spaces of the multilayer headbox, thereby preventing a premature mixing of the various stock flows.

Also known are paper machines for producing multiply paper layers with the aid of several headboxes acting mutually independently, such as described, for example, in German Patent Disclosure DE 40 31 038 A1. This document describes a paper machine in which there are plies of paper produced on several jointly running wires, independently of one another, which in subsequent processing—that is, still before the press section of the paper machine—are superposed to create multi-ply paper.

An unsolved problem with these multilayer and multiply papers is adjusting the basis weight cross profile and the fiber orientation cross profile of the web. The basis weight of the paper web is the weight of the paper per square unit. Although the basis weight should be constant over the width of the paper web, in practice it generally is not. The deviations of the basis weight from a desired value may be shown in a curve or "profile." The fibers (of a length of about 1 mm or less) should generally be oriented in the machine direction. In many cases, however, there may be a deviation from this direction. A "profile" of the fiber orientation will be created in the cross direction of the paper web. Notably, with a three-layer headbox it is very difficult to influence the center layer. Problems regarding the fiber orientation of the outer layers arise at the same time due to diaphragms provided on the nozzle.

The problem underlying the invention is to present for the preparation of a multi-ply or multilayer stock web a multilayer headbox that makes it possible to influence, independently of one another, the cross profiles of fiber orientation and basis weight in the individual plies and, thus, to provide a paper web with improved flatness, improved basis weight profile along with economical production.

SUMMARY OF THE INVENTION

This problem is solved by the features of the present invention. In one form thereof, the invention comprises a multilayer headbox of a paper machine for producing a paper web with several layers differing in their properties. Sectional volume flows with individually adjustable stock consistency are provided in at least one layer for adjustment of the basis weight cross profile. Sectional volume flows with adjustable flow are provided in at least one other layer for adjustment of the fiber orientation cross profile.

In another form thereof, the invention comprises a wet section of a paper machine for forming a multi-ply paper web wherein at least two successive headboxes are provided. The successively arranged headboxes are provided across the machine width with sectioned stock suspension supply.

For influencing the fiber orientation cross profile there is provided at least one headbox with—as regards the volume flow—sectionally adjustable flow. For influencing the basis weight cross profile there is provided at least one headbox with—as regards the stock consistency—individually adjustable sectional feed flow.

In still another form thereof, the present invention comprises a method for producing a multi-ply/multilayer paper web. Fed to the wire section(s) is(are) several layers/plies of stock suspension by means of at least one headbox wherein (1) the fiber orientation cross profile is influenced in at least one layer/ply; and (2) the basis weight cross profile is influenced in at least one other layer/ply.

The present inventor recognized the following: With multilayer and multi-ply papers it is necessary to adjust the cross profiles of fiber orientation and basis weight. In a modern headbox, the fiber orientation cross profile can be adjusted by sectional influencing of the volume flows, while the basis weight cross profile can be adjusted by way of sectionally influencing the stock consistency. The properties of the individual layers or plies differ fundamentally, e.g., in strength, raw material cost, tear performance and their effect on, e.g., the flatness of the sheet or the printability of the paper, respectively. By specific influencing of the fiber orientation of an outer layer or ply, the flatness of the sheet can be influenced very effectively, while a uniform basis weight is accomplished best by influencing the center layer.

Several examples are described with the aid of different paper types:

Three-layer Paper

With a paper consisting of three layers, the two outer layers are run with long-fiber stock suspensions, which are especially effective for influencing the fiber orientation as carried out there. The center layer is run with short fibers, the uniformity of the basis weight cross profile being adjusted in said center layer. The reason for influencing the flatness of the sheet by way of the outer layer is that, as the distance of a layer from the center layer of the sheet increases, small stresses in this layer also exert an increasing effect on the deformation of the sheet. These deformations are sectionally controlled by influencing the fiber orientation in the outer layer. The efficiency of this procedure is augmented by using in the outer layer preferably long fibers, which favor the necessary buildup of tension.

Two-layer Paper

Viewing a two-layer headbox in conjunction with a fourdrinier wire, the influence of cross flows in the nozzle, on the fiber orientation, is increased by the difference between jet velocity and screen travel. For this reason it is suitable to employ the layer on the near side of the wire for influencing the fiber orientation. Thus, influencing the fiber orientation would be performed in the layer facing the wire, and influencing the basis weight in the layer away from the wire.

A particular advantage in these described paper styles and methods for the manufacture of a paper web is that the influencing measures always are performed at the point of their maximum effect, and the necessary design prerequisites are limited to the absolutely necessary minimum.

BRIEF DESCRIPTION OF THE DRAWING

The above-mentioned and other features and advantages of this invention, and the manner of attaining them, will become more apparent and the invention will be better understood by reference to the following description of an embodiment of the invention taken in conjunction with the accompanying drawing, wherein.

DETAILED DESCRIPTION OF THE INVENTION

Figure 1:
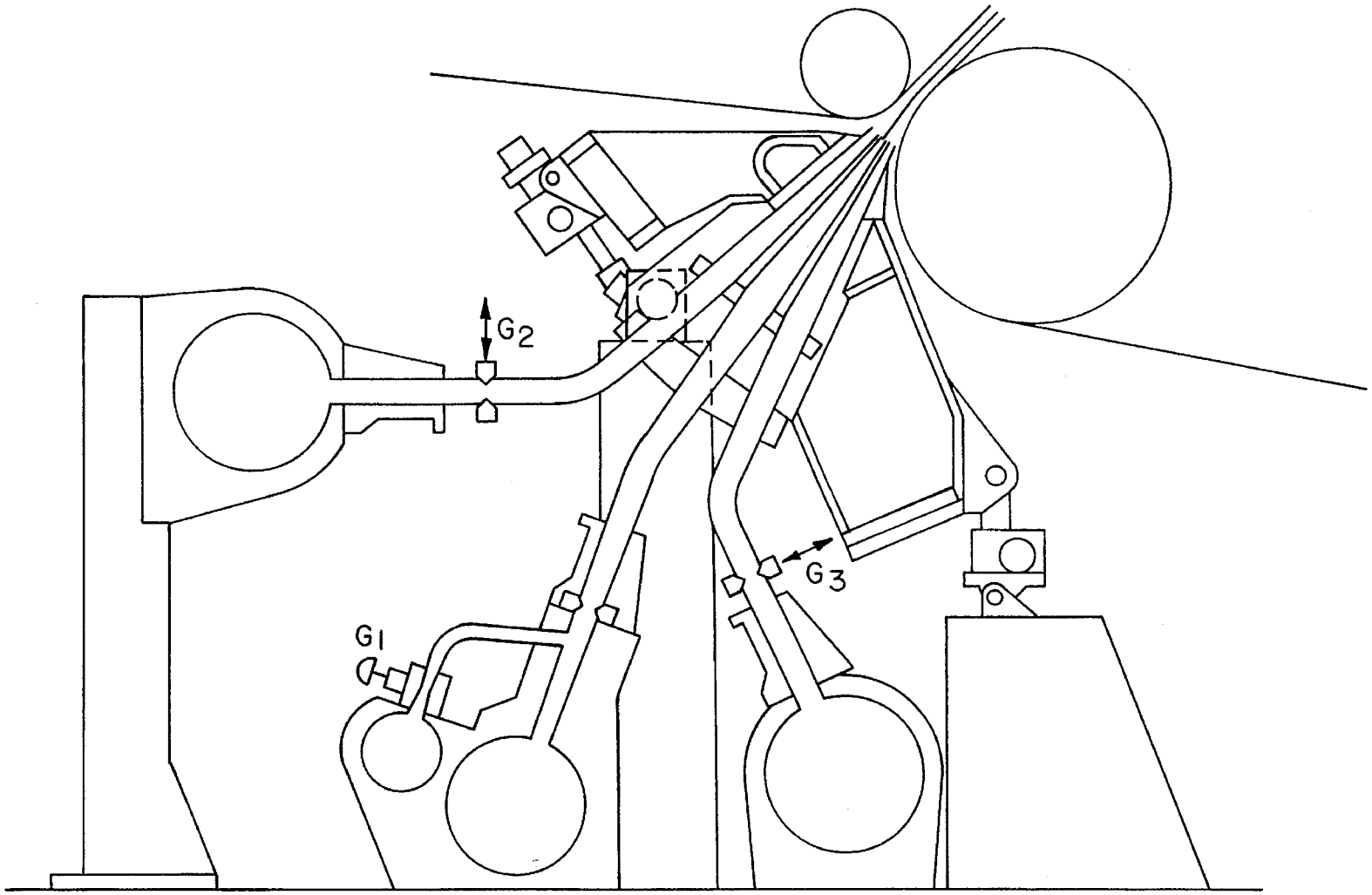
FIG. 1 illustrates a three-layer headbox wherein sectionally supplied stock suspension flows are controlled by constriction devices G2 and G3.

As shown in FIG. 1, a three-layer headbox can be configured in such a way that the sectionally supplied stock suspension flows of the peripheral layers are controlled merely by constriction devices G2 and G3. Constriction devices G2 and G3 influence the fiber orientation, while the center layer features a more expensive stock suspension feed with two different stock consistencies, which are fed sectionally to the center layer via a mixing system.

The headbox of the present invention produces a paper web built up of various layers. Each layer is produced by feeding sectional volume flows wherein one layer, as seen over the width of the layer (i.e. in cross machine direction) may be composed out of a number of suspension flows, one beside the other. The suspension flows may be variable in terms of the amount of pulp liquid suspension fed per second.

Utilized in the example illustrated in FIG. 1, for example, is the property of a mixing valve which is disclosed in the utility patent G 92 05 111, that when introducing a side flow in a main flow, the total volume of the flow discharging from the mixer remains constant, independently of the amount of side flow. In this way it is possible to perform with a single valve G1, per section, a sectional stock consistency variation of the center layer without creating at the same time an undesirable cross flow in this position, thereby keeping the fiber orientation always constant.

According to the invention, it is also possible to form a multilayer paper web, instead of with a single multilayer headbox, a corresponding multi-ply paper web with the aid of several successively arranged single-ply headboxes, with the properties of the individual plies being influenced in a fashion equivalent to the multilayer headbox.

The sectional volume flows may be adjusted with the aid of a diaphragm at the outlet gap. Alternatively, the sectional volume flows may be adjusted with the aid of a variable flow resistance before the outlet gap.

With such relatively complex adjustment options on a headbox, modern automatic measuring and control techniques are utilized, with which the respective fiber orientation and basis weight cross profile measurements can be performed and the various, sectionally and functionally coordinated valves controlled in on-line operation.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A multilayer headbox of a paper machine for producing a paper web having a plurality of layers, each of said plurality of layers having a basis weight cross profile and a fiber orientation cross profile, and wherein at least some of said plurality of layers have properties that differ from the properties of another layer, comprising:

means for providing sectional volume flows with individually adjustable stock consistency in at least one layer for adjustment of the basis weight cross profile of said at least one layer; and means for providing sectional volume flows with adjustable flow in at least one other layer for adjustment of the fiber orientation cross profile of said at least one other layer.

2. The multilayer headbox of claim 1, wherein each individual layer includes means for influencing either the sectional fiber orientation only or the sectional basis weight only.

3. The multilayer headbox of claim 1, in which said produced paper web consists of two layers, wherein said means for providing sectional volume flows with individually adjustable stock consistency is provided in one of said two layers for adjustment of the basis weight cross profile; and said means for providing sectional volume flows with adjustable flow is provided in the other of said two layers for adjustment of the fiber orientation cross profile.

4. The multilayer headbox of claim 1, wherein said produced paper web comprises three layers, said headbox further comprising said means for providing said sectional volume flows with individually adjustable stock consistency in the center one of said three layers for adjustment of the basis weight cross profile; and said means for providing said sectional volume flows with individually adjustable flow in at least one peripheral layer for adjustment of the fiber orientation cross profile.

5. A wet section of a paper machine for forming a multi-ply paper web, said web having a fiber orientation cross profile and a basis weight cross profile, comprising:

at least two successively arranged headboxes, said at least two successively arranged headboxes being provided across the paper machine width with sectioned stock suspension supply means; wherein at least one headbox includes a sectionally adjustable volume flow means for influencing the fiber orientation cross profile; and wherein at least one other headbox includes individually adjustable sectional stock consistency feed flow means for influencing the basis weight cross profile.

6. A method for producing a multi-ply or a multilayer paper web on at least one wire section, the web having a fiber orientation cross profile and a basis weight cross profile, comprising feeding a plurality of layers or plies of stock suspension to the at least one wire section by means of at least one headbox; influencing the fiber orientation cross profile in at least one of said layers or plies; and influencing the basis weight cross profile in at least one other of said at least one layers or plies.

7. The method of claim 6, wherein each one of said fiber orientation cross profile and basis weight cross profile is influenced without affecting the other of said fiber orientation cross profile and the basis weight cross profile.

8. The method of claim 6, wherein the fiber orientation cross profile and the basis weight cross profile are influenced, without affecting each other and independently of one another, in different layers or plies.

9. The method of claim 6, wherein the fiber orientation cross profile is influenced with the aid of adjustable sectional volume flows.

10. The method of claim 6, wherein the basis weight cross profile is influenced with the aid of adjustable sectional stock consistencies.

11. The method of claim 9, wherein the sectional volume flows are adjusted with the aid of a diaphragm on an outlet gap.

12. The method of claim 9, wherein the sectional volume flows are adjusted with the aid of a variable flow resistance before an outlet gap.

* * * * *